US005871637A

United States Patent [19]

Brons

[11] Patent Number: 5,871,637

[45] Date of Patent: Feb. 16, 1999

[54] PROCESS FOR UPGRADING HEAVY OIL USING ALKALINE EARTH METAL HYDROXIDE

[75] Inventor: Glen Brons, Phillipsburg, N.J.

[73] Assignee: Exxon Research and Engineering Company, Florham Park, N.J.

[21] Appl. No.: 933,918

[22] Filed: Sep. 22, 1997

Related U.S. Application Data

[63] Continuation of Ser. No. 730,617, Oct. 21, 1996, abandoned.

[51] Int. Cl.[6] ..... C10G 19/00

[52] U.S. Cl. ..... 208/283; 208/203; 208/226; 208/284; 208/391; 208/209; 208/214

[58] Field of Search ..... 208/203, 226, 208/283, 284, 391, 209, 214, 235

[56] References Cited

U.S. PATENT DOCUMENTS

| | | | |
|---|---|---|---|
| 2,934,496 | 4/1960 | Urban | 208/235 |
| 3,164,545 | 1/1965 | Mattox | 208/230 |
| 3,440,164 | 4/1969 | Aldridge | 208/218 |
| 3,449,242 | 6/1969 | Mattox et al. | 208/227 |
| 4,003,823 | 1/1977 | Baird, Jr. et al. | 208/108 |
| 4,007,109 | 2/1977 | Baird, Jr. et al. | 208/108 |
| 4,087,348 | 5/1978 | Baird, Jr. et al. | 208/226 |
| 4,127,470 | 11/1978 | Baird, Jr. et al. | 208/226 |
| 4,163,043 | 7/1979 | Dezael et al. | 423/234 |
| 4,310,049 | 1/1982 | Kalvinskas et al. | 166/267 |
| 4,437,980 | 3/1984 | Heredy et al. | 208/235 |
| 4,566,965 | 1/1986 | Olmstead et al. | 208/11 R |
| 5,635,056 | 6/1997 | Brons et al. | 208/227 |

OTHER PUBLICATIONS

LaCount et al., "Oxidation of Dibenzothiophene and Reaction of Dibenzothiophene 5,5–Dioxide with Aqueous Alkali," *Journal of Organic Chemistry*, 42 (16), 1977, no month.

Burger et al., "Symposium on Progress in Processing Synthetic Crudes and Resids," ACS (Aug. 24–29, 1975).

Yamaguchi et al., "Desulfurization of Heavy Oil and Preparation of Activated Carbon by Means of Coking Procedure," Chibakogyodaiku Kenkyui Hokoku No. 21, p. 115 (Jan. 30, 1976).

*Primary Examiner*—Walter D. Griffin
*Assistant Examiner*—Nadine Preisch
*Attorney, Agent, or Firm*—Linda M. Scuorzo

[57] ABSTRACT

The present invention relates to a continuous in-situ process for reducing the viscosity, corrosivity and density of heavy oils comprising the steps of (a) contacting a heavy oil with an aqueous alkaline earth, Group IIA metal hydroxide at a temperature of about 380° to about 450° C. for a time sufficient to form the corresponding alkaline earth metal sulfide, recovering the reduced sulfur feed and regenerating the alkaline metal hydroxide for recycle to treat additional feed. Beneficially, the process removes heteroatoms (sulfur and nitrogen).

2 Claims, No Drawings

PROCESS FOR UPGRADING HEAVY OIL USING ALKALINE EARTH METAL HYDROXIDE

This is application is a continuation of application U.S. Ser. No. 730,617, filed Oct. 21, 1996.

FIELD OF THE INVENTION

The present invention relates to a process for upgrading heavy oils, bitumen, tar sands, and other residuum feeds.

BACKGROUND OF THE INVENTION

The quality of residuum feeds, particularly heavy oils, suffers from high levels of heteroatoms (nitrogen and sulfur). Such feeds are also high in naphthenic acid contents (measured by total acid number—TAN) which presents corrosion problems in handling (e.g., refineries). These are highly viscous crudes that also possess relatively high densities or low API gravities. Transporting such heavy oils typically requires the blending with costly diluent which reduces the viscosity for pipelining.

Much work has been done utilizing molten caustic to desulfurize coals. For example, see "Molten Hydroxide Coal Desulfurization Using Model Systems," Utz, Friedman and Soboczenski, 51-17 (Fossil Fuels, Derivatives, and Related Products, ACS Symp. Serv., 319 (Fossil Fuels Util.), 51–62, 1986 CA 105(24):211446Z); "An Overview of the Chemistry of the Molten-caustic Leaching Process," Gala, Hemant, Srivastava, Rhee, Kee, Hucko, and Richard, 51-6 (Fossil Fuels, Derivatives and Related Products, Coal Prep. (Gordon and Breach), 71-1–2, 1–28, 1989 CA 112 (2):9527r; and Base-catalyzed Desulfurization and Heteroatom Elimination from Coal-model Heteroatomatic Compounds,"51-17 (Fossil Fuels, Derivatives, and Related Products, Coal Sci. Technol., 11 (nt. Conf. Coal Sci., 1987), 435-8, CA 108(18):153295y).

Additionally, work has been done utilizing aqueous caustic to desulfurize carbonaceous material. U.S. Pat. No. 4,437,980 discusses desulfurizing, deasphalting and demetallating carbonaceous material in the presence of molten potassium hydroxide, hydrogen and water at temperature of about 350° to about 550° C. U.S. Pat. No. 4,566,965 discloses a method for removal of nitrogen and sulfur from oil shale with a basic solution comprised of one or more hydroxides of the alkali metals and alkaline earth metals at temperatures ranging from about 50° to about 350° C.

Methods also exist for the regeneration of aqueous alkali metal. See e.g., U.S. Pat. No. 4,163,043 discussing regeneration of aqueous solutions of Na, K and/or ammonium sulfide by contact with Cu oxide powder yielding precipitated sulfide which is separated and re-oxidized to copper oxide at elevated temperatures and an aqueous solution enriched in NaOH, KOH or $NH_3$. Romanian patent RO-101296-A describes residual sodium sulfide removal wherein the sulfides are recovered by washing first with mineral acids (e.g., hydrochloric acid or sulfuric acid) and then with sodium hydroxide or carbonate to form sodium sulfide followed by a final purification comprising using iron turnings to give insoluble ferrous sulfide.

The costs for handling such feeds can be exorbitant. Hence, reducing viscosity and naphthenic acid content have become critical targets. Thus, there is a need for low-cost processes which upgrade oils to reduce the dependence on diluent addition and to produce more profitable feedstocks. Other upgrading targets include the reduction of nitrogen and sulfur.

SUMMARY OF THE INVENTION

The instant invention is directed toward a process for the reduction of viscosity and naphthenic acid contents in heavy oils. The process also increases API gravity significantly and decreases levels of heteroatoms such as nitrogen and sulfur. The process involves contacting a heavy oil with a Group IIA hydroxide, water and low pressure hydrogen to form the Group IIA sulfide and a heavy oil having decreased sulfur and nitrogen contents, lower viscosity (e.g., typically from 20,000 to greater than 100,000 cP to less than 2000 cP) and naphthenic acid concentrations (e.g., typically from 2 to 5 meq KOH (by titration) to less than 0.5 meq KOH) and higher API gravity (e.g., typically from less than or equal to 7 to $10^+$API). The heavy oil is recovered and the Group IIA sulfide by-product is removed and can be either regenerated for a continuous in-situ process or converted to a more environmentally friendly by-product for disposal or sale. Optionally, the process can recycle the Group IIA sulfide and excess Group IIA hydroxide by-product to the initial reactor for reuse until the hydroxide is depleted or reduced to ineffective levels.

Regeneration of the desulfurization agent can be accomplished by treatment of the Group IIA sulfide formed (a) with $H_2S$ followed by steam stripping or (b) with $CO_2$ and $H_2O$ to form Group IIA carbonate followed by calcining water quenching. Alternatively, the Group IIA sulfide can be oxidized to the Group IIA sulfate (e.g., $CaSO_4$ or gypsum for calcium) which can be sold or disposed of. The preferred Group IIA metal is calcium. As used herein, contacting includes reacting.

DETAILED DESCRIPTION OF THE INVENTION

Applicants have found that water, Group IIA hydroxides (preferably calcium hydroxide) and hydrogen is capable of decreasing the viscosity and corrosivity of heavy oils while decreasing the heteroatom contents, increasing the API gravity of the feed and minimizing formation of the product oil as solids. Applicants believe that the presence of water during treatment reduces the amount of heavier end materials (such as asphaltenes and other coking precursors measured by Micro Carbon Residue (MCR)) by acting as a medium which inhibits undesirable secondary reactions which lead to coke formation (such as addition reactions of radicals, formed via thermal cracking, to aromatics forming heavy-end, low value products). Heavy oils as used herein includes vacuum resids, atmospheric resids, heavy crudes where greater than 50% of the components of such crudes boil at 1050° F. and higher, and high sulfur crudes containing greater than 0.5% of sulfur.

The addition of at least one aqueous hydroxide, i.e., Group IIA hydroxide allows for the initial product from the desulfurization step i.e., the corresponding alkaline earth sulfide to further react in one of several ways to regenerate the alkaline earth hydroxide or conversion to the corresponding Group IIA sulfate as a by-product.

The concentration of aqueous Group IIA hydroxide added to the sulfur containing feedstock will range from about 5 wt % to about 30 wt %, preferably about 5 wt % to about 10 wt % based on the weight of the feedstock. Such concentrations provide a mole ratio of about 0.5:1 to about 1:1 alkaline earth metal hydroxide:sulfur. The water added to the system will range from 5 wt % to 100% preferably about 5 wt % to 50 wt % based on the weight of the feedstock. This also represents a range of 50 to 100 wt % of Group IIA hydroxide based on the weight of the water. Although a one-time reaction of the aqueous hydroxide with the feedstock is sufficient, subsequent treatments of the feedstock with additional Group IIA hydroxide aqueous hydroxide can be performed. The by-product Group IIA sulfide and unreacted Group IIA hydroxide can also be recycled to the primary reaction for further treatments.

The hydroxide and feedstock will be reacted at a temperature of about 380° to about 450° C., preferably the temperature will be between 390° to 410° C. The reaction times are typically at least about 5 minutes to about three hours, more typically the reaction time will be about 10 minutes to one hour. Temperatures of at least 380° C. are necessary to remove sulfur via thermal means to result on $H_2S$ formation, which is then scrubbed from the system internally to form the Group IIA sulfide. Preferably, reaction temperatures are maintained at or below about 425° C. for treatment times of less than 30 minutes to further prevent excessive cracking reactions from occurring.

In a preferred embodiment of the invention, molecular hydrogen will be added to the aqueous hydroxide system. Such hydrogen addition aids in capping off radicals formed during heating and in forming the initial $H_2S$ product. The pressure of the hydrogen added will be from about 50 psi (345 kPa) to about 500 psi (3450 kPa), preferably about 100 psi (690 kPa) to about 200 psi (1300 kPa) (cold charge) of the initial feed charge.

The present invention not only removes organically bound sulfur from the feedstocks but advantageously also removes nitrogen. The invention is capable of removing 20 percent or more of such organically bound sulfur from the sulfur containing feedstock. In addition, significant conversion of these heavy oils to lighter materials is evidenced by observed reductions in micro carbon residue ("MCR") contents, density, and viscosity. Whereas, treatments without Group IIA hydroxide present generate more gas and solids formation (less oil) and increase overall MCR values.

Once the alkaline earth metal hydroxide treatment of the crude oil has been concluded (whether as a batch or recycled process), the alkaline earth metal sulfide generated can then be treated in a number of different steps. Using Ca as an example, the alkaline earth metal sulfide may react as follows:

$$CaS \xrightarrow{+H_2S} Ca(HS)_2 \xrightarrow{\text{steam}} Ca(OH)_2 + H_2$$

or, $$CaS \xrightarrow{+H_2S} Ca(HS)_2 \xrightarrow{4/5\ O_2} 2/5\ CaS_5 + 2/5 H_2O + 3/5\ Ca(OH)_2$$

-continued or, $$CaS \xrightarrow{CO_2 + H_2O} CaCO_3 + H_2S \xrightarrow[-H_2S]{+\text{heat}} CaO + CO_2 \xrightarrow[+CO_2]{+H_2O} Ca(OH)_2$$

In each instance the process is carried out as a continuous process in which the treated, reduced sulfur content oil is withdrawn and the alkaline earth hydroxide is converted into the corresponding sulfide which is further treated to regenerate the alkaline earth hydroxide for recycle to treat additional starting crude.

If a steam stripping step is chosen to regenerate the alkaline earth metal hydroxide, the reaction can be carried out at temperatures of about 150° to about 300° C., for reaction times sufficient to remove the hydrogen sulfide. Reaction times are easily determined by one skilled in the art. The other two are carried out at atmospheric pressures and ambient temperature.

As an alternative to regeneration, the produced Group IIA sulfide from the process can also be oxidized under ambient temperatures and pressures to form the corresponding Group IIA sulfate which can be disposed of or sold.

The following examples are for illustration and are not meant to be limiting.

The following examples illustrate the effectiveness of aqueous Group IIA hydroxide (calcium hydroxide is used as an example) systems to upgrade the heavy oils by reducing viscosity, TAN, sulfur and nitrogen while increasing API gravity. The experimental conditions include a temperature range of from about 400° to about 410° C. for 10 to 45 minutes.

Autoclave experiments on a heavy oil demonstrate the ability of aqueous calcium hydroxide treatments in the preferred temperature range of 390° to 410° C. to dramatically reduce the viscosity and corrosivity (from TAN measurements) of the oil (Table 1). In addition, the API gravity is increased by as much as 75% with reductions in sulfur and nitrogen contents of up to 20% and 16%, respectively. In each of these systems, less than 0.6 wt % coke make occurred with essentially no increase in the MCR content of the oil.

An experiment carried out without water and $Ca(OH)_2$ (Exp. ID 96S, Table 1), relative to experiments 96Q and 96R (similar conditions), demonstrates that less desulfuirization occurs. More importantly, more than ⅓ of the product oil existed as solids. This comparison illustrates the importance of the presence of both water and calcium hydroxide.

TABLE 1

Aqueous $Ca(OH)_2$ Treatments of Heavy Oil

| | | Exp. ID | | | | |
|---|---|---|---|---|---|---|
| | Initial | 96Q | 96R | 96S | 96U | 96V |
| Heavy Oil (grams) | | 45.61 | 45.15 | 42.77 | 45.35 | 45.10 |
| $Ca(OH)_2$:S Ratio (molar) | | 0.5:1 | 1:1 | None | 0.5:1 | 0.5:1 |
| $H_2O$:Oil Ratio (w/w) | | 1:9 | 1:9 | None | 1:18 | 1:18 |
| Temperature (°C.) | | 410 | 410 | 410 | 410 | 400 |
| Time (minutes) | | 45 | 45 | 45 | 15 | 10 |
| $H_2$ Charge (psig) | | 405 | 403 | 400 | 200 | 202 |

TABLE 1-continued

| Aqueous $Ca(OH)_2$ Treatments of Heavy Oil | | | | | | |
|---|---|---|---|---|---|---|
| | | Exp. ID | | | | |
| | Initial | 96Q | 96R | 96S | 96U | 96V |
| Oil Product | | | | | | |
| Wt % Nitrogen | 0.74 | 0.66 | 0.62 | — | 0.67 | 0.64 |
| Wt % Sulfur | 4.20 | 3.46 | 3.45 | 3.68 | 3.85 | 3.79 |
| S/C Ratio | 0.0188 | 0.0154 | 0.0152 | — | 0.0168 | 0.0171 |
| % S Removal | — | 18.1 | 19.1 | 12.4 | 10.6 | 9.8 |
| Wt % MCR | 15.2 | 15.7 | 14.4 | — | — | 15.7 |
| Viscosity (cP, 40° C.) | 51,000 | 140 | — | — | 450 | 820 |
| TAN Index | 4.6 | 0.3 | — | — | 0.8 | — |
| API | 7.8 | 13.6 | 13.5 | — | 8.6 | 10.1 |
| Coke (wt %) | — | <0.6 | — | <0.7 | <0.4 | <0.3 |

What is claimed is:

1. A continuous in-situ process for decreasing the viscosity and corrosivity of heavy oils and increasing the API gravity and decreasing heteroatom content comprising:

(a) contacting a heavy oil with water and at least one alkaline earth metal hydroxide in an amount of from 50 to 100 wt % alkaline earth metal hydroxide based on the weight of the water at a temperature of about 380° to about 450° C. for a time sufficient to form the corresponding alkaline earth metal sulfide and a heavy oil having a decreased viscosity and corrosivity and organically bound sulfur content;

(b) recovering the heavy oil having a decreased viscosity and corrosivity and organically bound sulfur content;

(c) reacting the alkaline earth metal sulfide with $H_2S$ to form an alkaline earth metal hydrosulfide and oxidizing the alkaline earth metal hydrosulfide to regenerate the corresponding alkaline earth metal hydroxide and form water and the corresponding alkaline earth metal pentasulfide;

(d) recirculating the regenerated alkaline earth metal hydroxide from step (c) to step (a).

2. A continuous in-situ process for decreasing the viscosity and corrosivity of heavy oils and increasing the API gravity and decreasing heteroatom content, comprising:

(a) contacting a heavy oil with water and at least one alkaline earth metal hydroxide in an amount of from 50 to 100 wt % alkaline earth metal hydroxide based on the weight of the water at a temperature of about 380° to about 450° C. for a time sufficient to form the corresponding alkaline earth metal sulfide and a heavy oil having a decreased viscosity and corrosivity and organically bound sulfur content;

(b) recovering the heavy oil having a decreased viscosity and corrosivity and organically bound sulfur content;

(c) reacting the alkaline earth metal sulfide with $CO_2$ and water to form the corresponding alkaline earth metal carbonate and $H_2S$, removing the $H_2S$, heating the alkaline earth metal carbonate at greater than 800° C. to form the corresponding alkaline earth metal oxide and $CO_2$, and quenching the alkaline earth metal oxide with water to regenerate the corresponding alkaline earth metal hydroxide;

(d) recirculating the regenerated alkaline earth metal hydroxide from step (c) to step (a).

* * * * *